US009351059B1

(12) United States Patent
Suhre

(10) Patent No.: US 9,351,059 B1
(45) Date of Patent: May 24, 2016

(54) ORTHOGONAL OPEN BACK SPEAKER SYSTEM

(71) Applicant: James R. Suhre, North Las Vegas, NV (US)

(72) Inventor: James R. Suhre, North Las Vegas, NV (US)

( * ) Notice: Subject to any disclaimer, the term of this patent is extended or adjusted under 35 U.S.C. 154(b) by 0 days.

(21) Appl. No.: 14/479,237

(22) Filed: Sep. 5, 2014

Related U.S. Application Data

(60) Provisional application No. 61/874,221, filed on Sep. 5, 2013.

(51) Int. Cl.

| | |
|---|---|
| ***H04R 1/20*** | (2006.01) |
| ***H04R 1/02*** | (2006.01) |
| ***H04R 3/00*** | (2006.01) |
| *H04R 1/28* | (2006.01) |

(52) U.S. Cl.
CPC ..... *H04R 1/025* (2013.01); *H04R 3/00* (2013.01); *H04R 1/2819* (2013.01); *H04R 1/2826* (2013.01); *H04R 1/2857* (2013.01); *H04R 1/2865* (2013.01); *H04R 2400/13* (2013.01)

(58) Field of Classification Search
CPC .. H04R 1/2819; H04R 1/2826; H04R 1/2857; H04R 1/2865; H04R 2201/029
See application file for complete search history.

(56) References Cited

U.S. PATENT DOCUMENTS

| | | | | | |
|---|---|---|---|---|---|
| 2,277,525 | A | * | 3/1942 | Mercurius | H04R 1/2819 181/156 |
| 2,642,948 | A | * | 6/1953 | Olson | H04R 1/2819 181/152 |
| 3,203,502 | A | * | 8/1965 | Rife | H04R 1/2865 181/156 |
| 4,224,469 | A | | 9/1980 | Karson | |
| 4,482,026 | A | * | 11/1984 | Stehlin, Jr. | H04R 1/2811 181/152 |
| 4,524,846 | A | | 6/1985 | Whitby | |
| 4,616,731 | A | | 10/1986 | Robinson | |
| 4,940,108 | A | | 7/1990 | Selby | |
| 5,173,575 | A | * | 12/1992 | Furukawa | H04R 1/2826 181/148 |
| 5,177,329 | A | | 1/1993 | Klayman | |
| 5,373,564 | A | | 12/1994 | Spear et al. | |
| 5,734,728 | A | | 3/1998 | Meissner | |

(Continued)

FOREIGN PATENT DOCUMENTS

| | | | | | |
|---|---|---|---|---|---|
| DE | 2638053 | A1 | * | 3/1978 | H04R 1/2865 |
| FR | 709411 | A | * | 8/1931 | H04R 1/2865 |

OTHER PUBLICATIONS

Speaker Primer, vol. 1, No. 1, 1994, Revised Jul. 2003; www.hometheaterhifi.com.

(Continued)

*Primary Examiner* — Curtis Kuntz
*Assistant Examiner* — Ryan Robinson
(74) *Attorney, Agent, or Firm* — John C. Lambertsen

(57) ABSTRACT

A loudspeaker system has one or more drivers having their back side connected to a duct that is open at the top end and closed at the bottom end. A diverter is attached to the back side of each driver to deflect its back output wave approximately 90 degrees toward the open end of the duct. A pair of woofers are arranged back-to-back and joined together at the bottom of the duct, the front side of each woofer adjacent an opening in the duct. A port aperture is provided at a vertical location in the duct to provide a null at that location. The front wave of the drivers is directed toward the listener and the back wave is directed toward the ceiling, spreading out and down into the room, to be met by the front wave; the opposite phases canceling, eliminating excitation of room resonances and reflections.

10 Claims, 5 Drawing Sheets

(56) References Cited

U.S. PATENT DOCUMENTS

| | | | | |
|---|---|---|---|---|
| 5,872,339 | A * | 2/1999 | Hanson | H04R 1/26 181/144 |
| 6,095,279 | A | 8/2000 | Adamson | |
| 6,411,721 | B1 | 6/2002 | Spindler | |
| 6,438,249 | B1 | 8/2002 | Wiener | |
| 6,618,488 | B2 * | 9/2003 | Nakamura | H04R 1/2819 181/199 |
| 7,218,747 | B2 * | 5/2007 | Huffman | H04R 1/2826 381/338 |
| 7,388,963 | B2 | 6/2008 | Han et al. | |
| 8,397,860 | B2 | 3/2013 | Rodgers | |
| 2002/0118858 | A1 | 8/2002 | White et al. | |
| 2005/0087392 | A1 | 4/2005 | Flanders et al. | |
| 2005/0169494 | A1 * | 8/2005 | Stiles | H04R 1/02 381/337 |
| 2007/0261911 | A1 * | 11/2007 | Nichols | H04R 1/2826 181/150 |
| 2012/0177238 | A1 * | 7/2012 | Enamito | H04R 1/2819 381/349 |
| 2012/0288129 | A1 | 11/2012 | Suhre | |
| 2013/0004007 | A1 | 1/2013 | Beardsley | |

OTHER PUBLICATIONS

Open-Back and Closed-Back Speaker Enclosures, posted May 9, 2012, www.fender.com.

* cited by examiner

ORTHOGONAL OPEN BACK SPEAKER SYSTEM

RELATED APPLICATIONS

The present application claims the benefit of priority under 35 USC §119(e) to U.S. Provisional Application No. 61/874,221, filed on Sep. 5, 2013, which is incorporated by reference herein for all that it contains.

BACKGROUND OF THE INVENTION

1. Field of the Invention

The present invention relates to sound reproduction systems and, more particularly, to speaker enclosures for audio reproduction systems. More specifically, the present invention relates to a loudspeaker system having one or more drivers having their back side connected to a duct enclosure that is closed at the bottom end and open at the top end.

2. Description of the Related Art

Transient response test data, (such as waterfall, step, and impulse), taken for practical, commercially-feasible loudspeakers of all types show significant late-arriving acoustic energy. This energy distorts musical notes and transients of all types.

In box speakers most of the residual energy is contained in the air inside of the box. Even with acoustic absorption material in the box, time is required to eventually absorb the energy by friction. Similarly, horn speakers have a cavity behind the dome and/or cone, plus the acoustic resonances (organ pipe) in the length of the horn that accumulate energy.

"Planar" speakers, electro-static or electromagnetic (Magneplanar or "Maggies") require large frontal areas because of their small displacement capabilities. Part of the surface is further away from the listener, and therefore part of the acoustic wave arrives later than the first part of the wave. Also, planar speakers must stand well away from the wall behind them to minimize reflected wave interference.

A flat panel open back speaker has minimal residual energy (the cone kinetic energy is rapidly damped), but the frontal area has to be impractically large to produce lower bass notes. Also, as with planar speakers, flat panels must stand well away from the wall behind to avoid interference. Bending back the outer portions of a large flat baffle reduces the frontal area while maintaining a sufficiently long acoustic pathway. As the depth increases acoustic resonances (organ pipe) occur and must be addressed.

A need exists to produce a practical loudspeaker having, along with the general capabilities, an excellent bass and transient response as would be provided by obtaining a low residual energy ("LRE").

SUMMARY OF THE INVENTION

In the context of the present invention, a "driver" is a device that converts power into force to move at audio frequency a structure having an area perpendicular to the axis of motion to produce sound. The required force is generally obtained by electrical means, but other power sources are possible. One side of the moving structure is in opposite phase from the other side, and provision is required to separate the front wave from the rear wave. A "duct" is a structure having flat or curved walls that are sufficiently heavy and rigid to prevent excessive acoustic transmission through the wall while conducting sound waves along its length.

The present invention utilizes one or more drivers, each having their back side connected to a duct that is closed at the bottom end and open at the top end. A short piece of elbow or a baffle is used with each driver to divert its back output wave approximately 90 degrees toward the open end of the duct. The distance along the duct from each driver to the open end is sufficient to prevent early cancellation by the out-of-phase back wave, thus obtaining sufficient bass response for each driver.

In some cases the duct may be so long that it would include a resonance in the upper end of the frequency band of the driver. The resonance frequency can be multiplied by adding one or more ports in the manner of holes in a flute.

In a presently preferred embodiment, one main duct is used having sufficient cross section to not restrict the woofer pressure wave. Attached to the same duct above the woofers, and at listening level, are the higher frequency drivers with turning ducts and baffles. Residual energy is minimized.

An aspect of embodiments in accordance with the present invention is an orthogonal open back speaker system comprising: a duct housing defining an interior acoustic space, said duct housing having a top end and a bottom end, wherein said duct housing is closed at said bottom end and open at said top end; a driver mounted in said duct housing, wherein said back side of said driver is in acoustic communication with said interior acoustic space of said duct housing; and an acoustic diverter attached to said back side of said driver, said acoustic diverter positioned relative to said back side of said driver in a manner directing acoustic energy of said back side toward said open top end of said duct housing.

Another aspect of embodiments in accordance with the present invention is a speaker system comprising: first and second drivers having respective front and rear surfaces for radiating acoustic energy; a duct housing defining an elongate linear enclosure having top and bottom ends, wherein said top end is open and said bottom end is closed, said duct housing having a front panel, the front panel having a pair of apertures therethrough for receiving said first and second drivers, respectively; and a first and second diverter, each attached to said rear surface of a respective one of said first and second drivers, with said first and second drivers and attached first and second diverters oriented to divert acoustic energy radiated by said rear surface in a direction toward the open top end of said duct housing.

It is to be understood that the invention is not limited in its application to the details of construction and the arrangement of components described hereinafter and illustrated in the drawing figures. Those skilled in the art will recognize that various modifications can be made without departing from the scope of the invention.

These and other objects, aspects, and features of the present invention will be better understood from the following description of embodiments when read in conjunction with the appended drawing figures.

BRIEF DESCRIPTION OF THE DRAWINGS

Embodiments in accordance with the present invention are described below in connection with the accompanying drawing sheets.

DETAILED DESCRIPTION OF THE PREFERRED EMBODIMENTS

Reference is now made to the drawings wherein like structures refer to like parts throughout.

Figure 1:
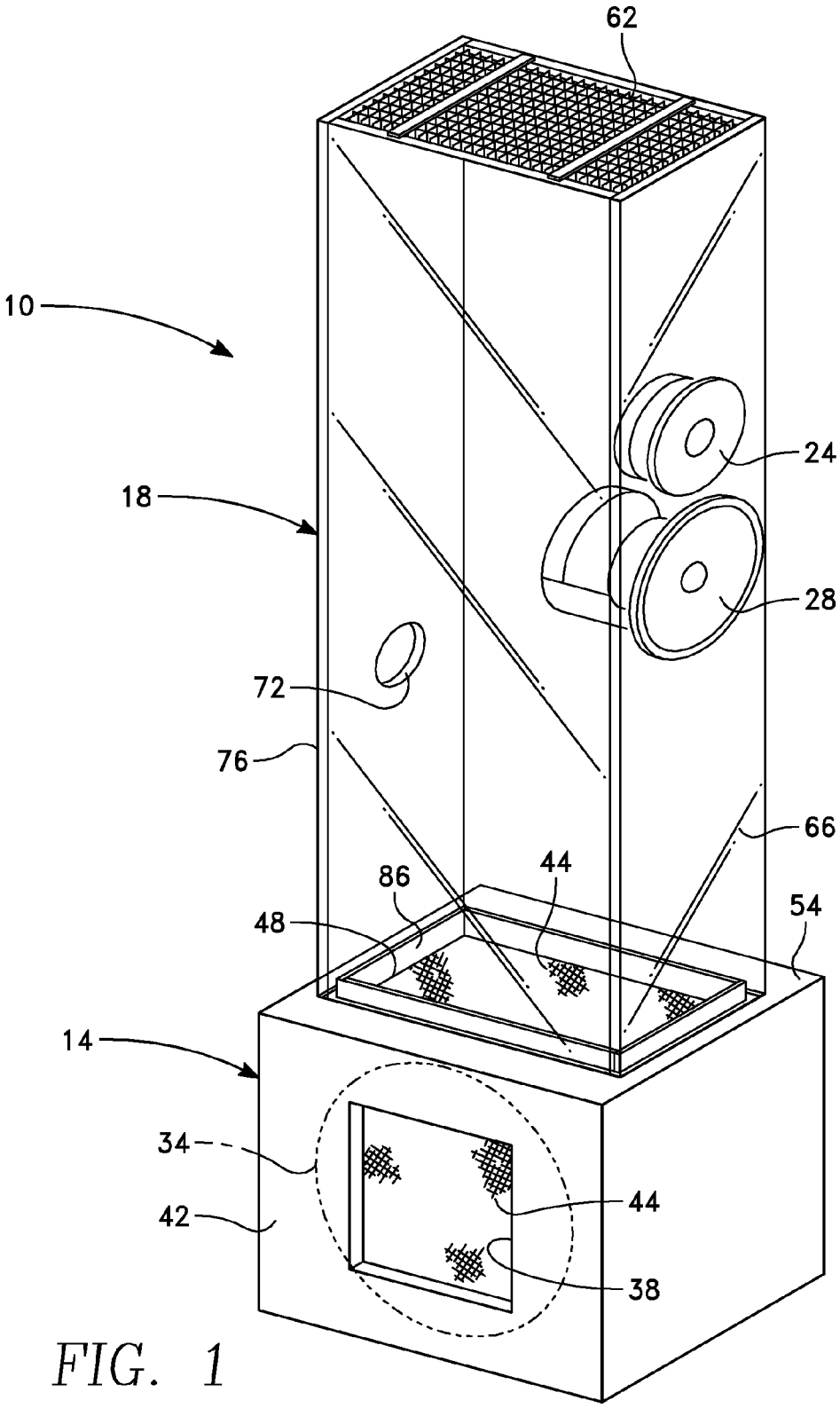
FIG. 1 is a perspective view, with portions in phantom, showing an orthogonal open back speaker system in accordance with the present invention.

In FIG. 1 an orthogonal open back speaker system 10 includes a woofer housing 14 and an upper housing 18, the latter having a tweeter driver 24 and a mid-woofer driver 28 mounted therein. A pair of woofers 34 are mounted within the woofer housing 14, with each located adjacent a woofer opening 38 formed in each lateral panel 42 of the woofer housing 14, and covered by speaker cloth 44 (only one woofer is shown in phantom in FIG. 1).

The woofer housing 14 is acoustically joined with the upper housing 18 by a woofer duct opening 48 formed in a top panel 54 of the woofer housing 14. The woofer housing 14 and the upper housing 18 together comprising a duct housing defining interior acoustic space for the orthogonal open back speaker system 10.

The woofer duct opening 48 is preferably covered by a piece of the speaker cloth 44. The upper housing 18 is four-sided, with an open top 58, (see FIG. 2), and bottom, a protective grid 62 is received by and mounted in the open top 58 of the upper housing 18 to protect the interior of the upper housing 18 from the inadvertent introduction of small objects.

The tweeter driver 28 and the mid-woofer driver 28 are mounted in a front panel 66 of the upper housing 18, preferably with the tweeter driver 24 in superposed relation to the mid-woofer driver 28. A port 72 is formed in a rear panel 76 of the upper housing 18, the port 72 providing a null in the longitudinal cavity resonance at its vertical location.

Figure 2:
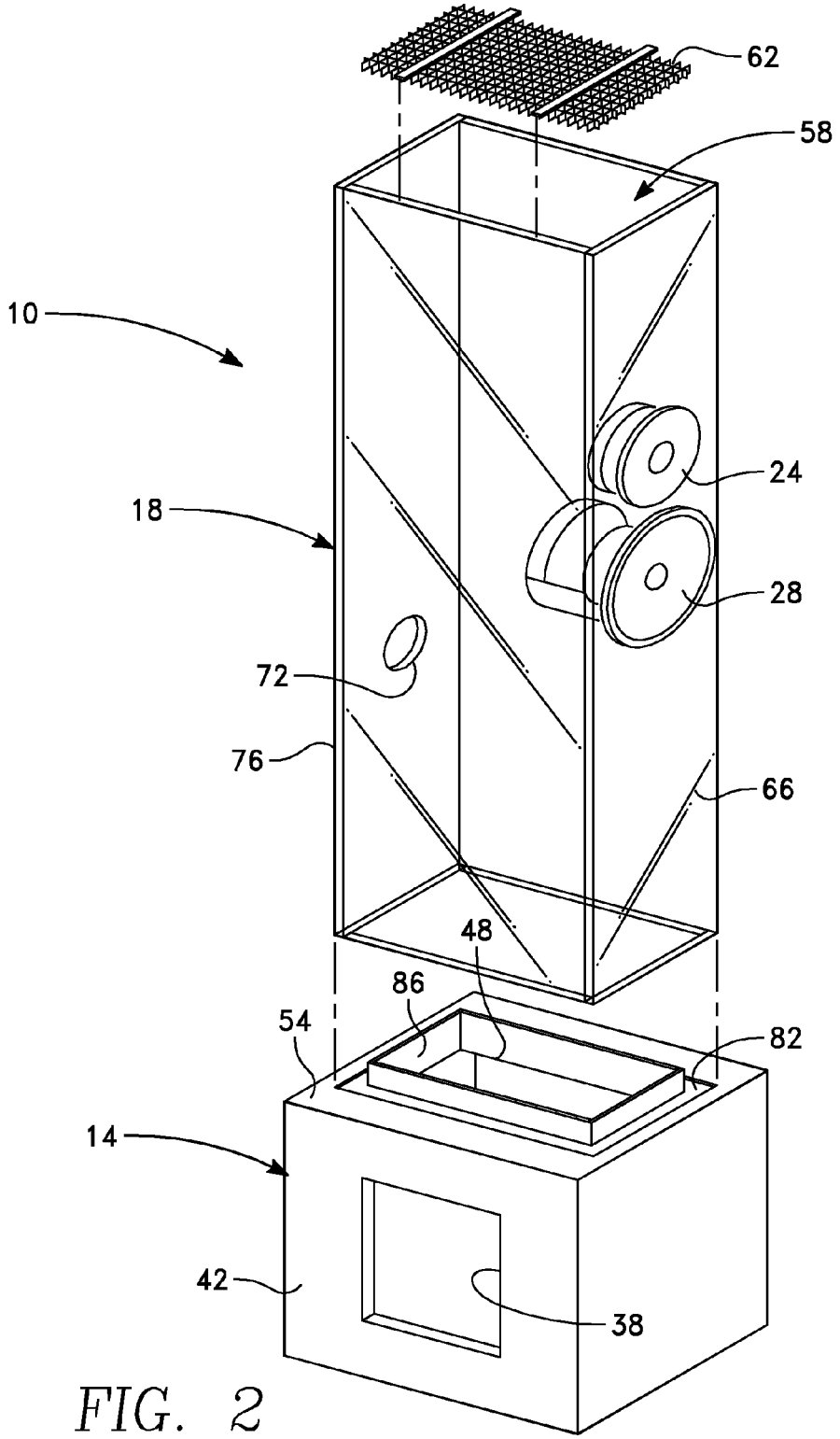
FIG. 2 is an exploded perspective view, with portions in phantom, showing the orthogonal open back speaker system of FIG. 1.
Figure 12:
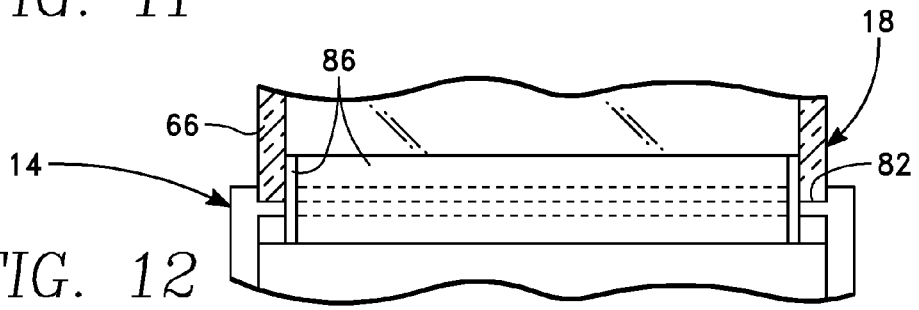
FIG. 12 is a partial cross-sectional view taken along line 12-12 of FIG. 11 showing an interface between the woofer housing and the upper housing of the orthogonal open back speaker system of the present invention.

As shown in FIG. 2 the upper housing 18 rests upon the woofer housing 14 and is received by a channel 82 formed in the top panel 54 of the woofer housing 14 about the periphery of the woofer duct opening 38. A retaining collar 86 is attached to and projects up from the edge of the woofer duct opening about the entire circumference thereof, in a manner such that upon placement of the upper housing 18 upon the woofer housing 14 the retaining collar 86 abuts the adjacent inner surface of the upper housing 18, thereby securing the upper housing 18 in place and position upon the woofer housing 14. This same structure is depicted in cross section in FIG. 12. Although the channel 82 is shown in the Figures, in a presently preferred embodiment the retaining collar 86 is sufficient to properly position and retain the upper housing 18 upon the top panel 54 of the woofer housing 14.

Figure 6:
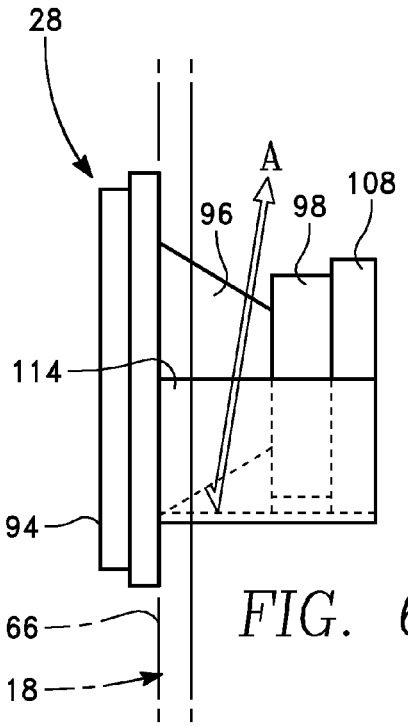
FIG. 6 is a partial side elevation view, with portions shown in phantom, of the mid-woofer driver of FIGS. 3, 4, and 5 as mounted in the orthogonal open back speaker system of the present invention.
Figure 3:
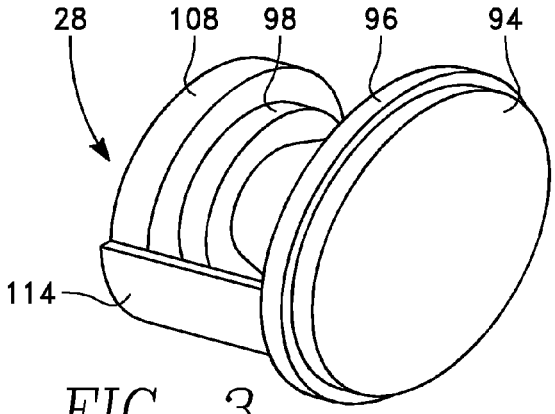
FIG. 3 is a front perspective view of a mid-woofer driver having a rigid disk attached to the back side of the driver and a metal baffle attached to the underside of the driver in accordance with the present invention.
Figure 4:
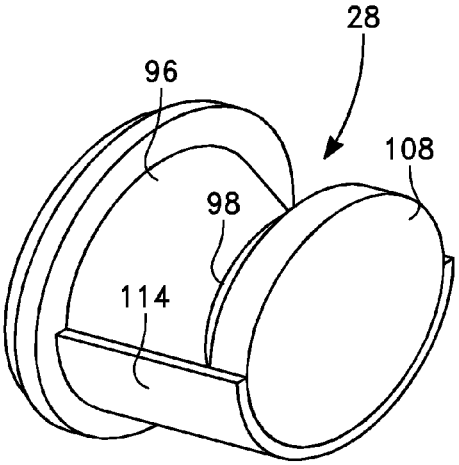
FIG. 4 is a rear perspective view of the mid-woofer driver of FIG. 3.
Figure 5:
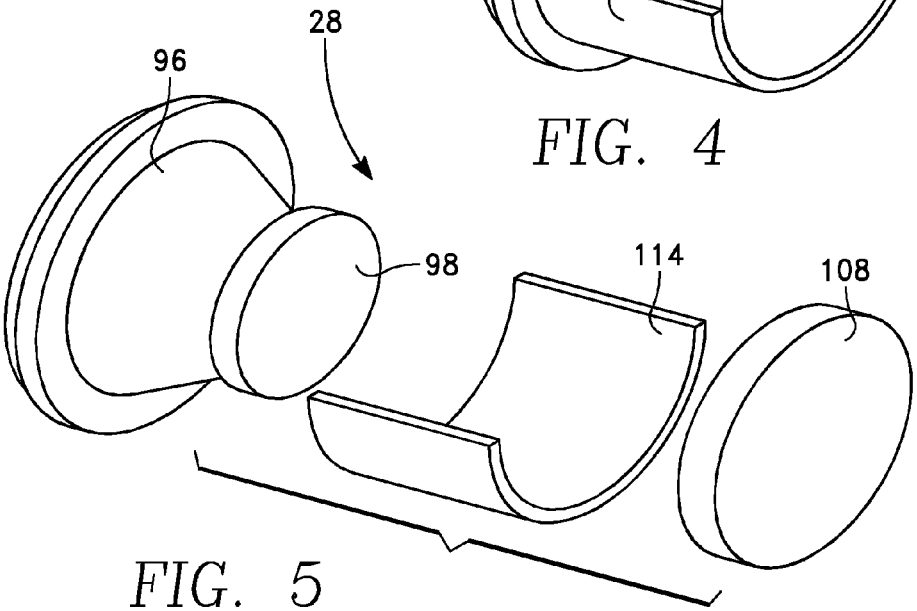
FIG. 5 is an exploded rear perspective view of the mid-woofer driver of FIGS. 3 and 4.

FIG. 3 shows the mid-woofer driver 28, having a diaphragm 94 facing frontwards, with a diaphragm housing 96 and a magnet housing 98 extending back from the diaphragm 94. A rigid disk 108 is attached to the back end of the magnet housing 98 and a metal baffle 114 is attached to the underside of the mid-woofer driver 28, extending from its attachment to the front of the diaphragm housing 96 to the rigid disk 108. FIGS. 4 and 5 show additional details regarding the attachment locations for the rigid disk 108 and the metal baffle 114. The resulting mid-woofer driver 28 is shown mounted in the front panel of the upper housing 18 in FIG. 6, with Arrow A depicting the back output of the driver being directed upward by the metal baffle 114, which acts as an acoustic diverter.

Figure 9:
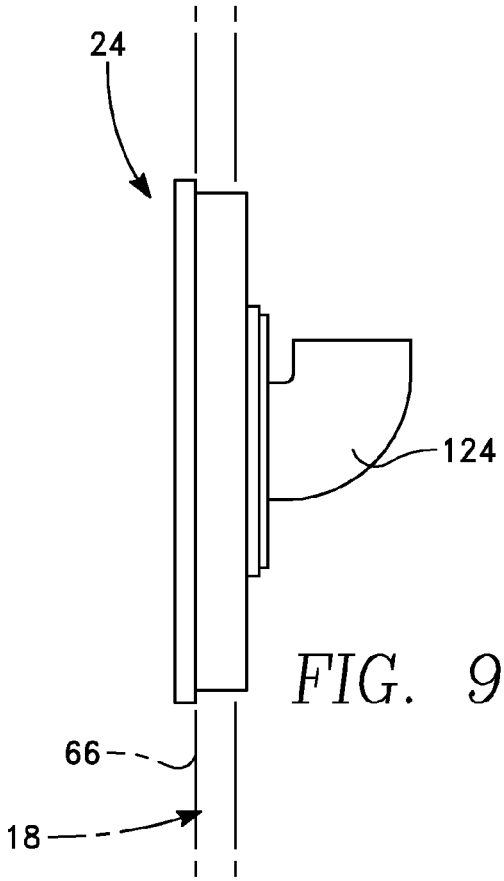
FIG. 9 is a partial side elevation view, with portions shown in phantom, of the tweeter driver of FIGS. 7 and 8 as mounted in the orthogonal open back speaker system of the present invention.
Figure 7:
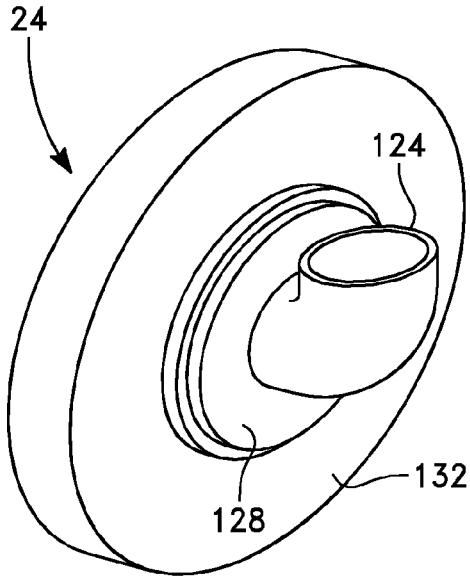
FIG. 7 is a front perspective view of a tweeter driver having a short piece of elbow attached to the back side of the driver in accordance with the present invention.
Figure 8:
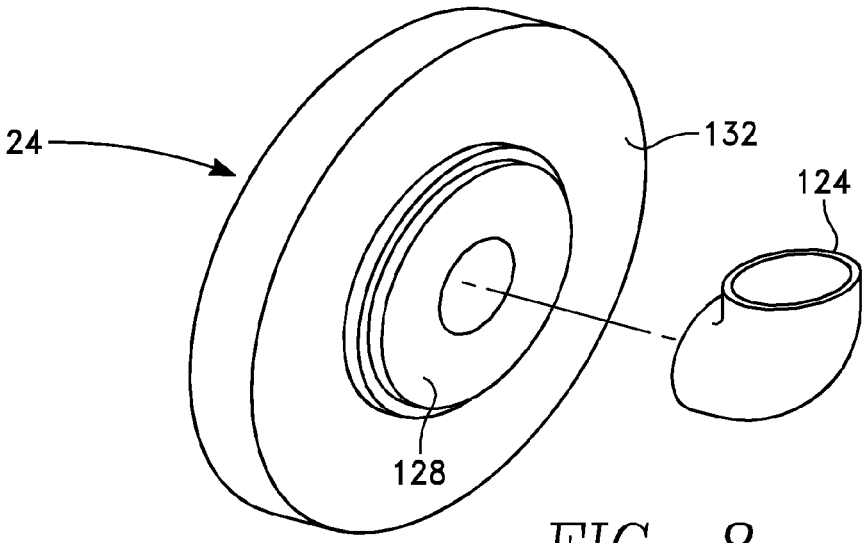
FIG. 8 is an exploded rear perspective view of the tweeter driver of FIG. 7.

FIGS. 7, 8, and 9 show the tweeter driver 24 as modified in accordance with the present invention to direct the back output of the tweeter driver 24 upwards and toward the open top 58 of the upper housing 18. In FIG. 7 an elbow duct 124 is attached to a rear surface 128 of a magnetic housing 132. Such attachment is also depicted in FIG. 8.

Tweeter drivers typically include a sound capturing chamber that is attached to the rear surface of the magnetic housing (not shown in the Figures), to absorb the back output of the tweeter driver. In FIG. 8, such sound capturing chamber has been removed, providing access to the rear surface 128 of the magnetic housing 132. Attachment of the elbow duct 124 to the rear surface 128 of the magnetic housing 132 permits the back output of the tweeter driver 24 to be captured by the elbow duct 124 and be directed upward and toward the open top 58 of the upper housing 18 when the tweeter driver 24 is mounted in the front panel 66 of the upper housing 18, as is shown in FIG. 9. The elbow duct 124 acts as an acoustic diverter.

Figure 10:
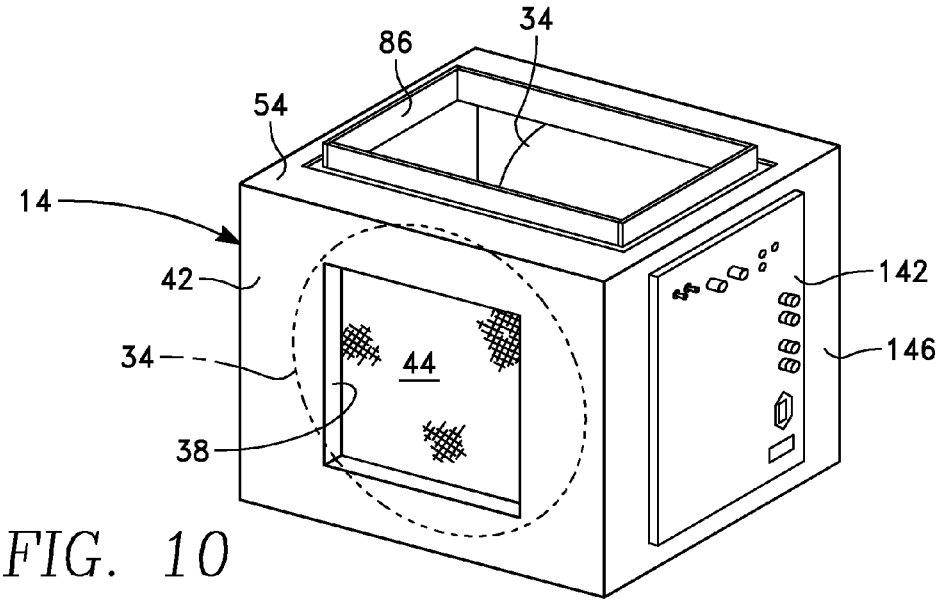
FIG. 10 is a perspective view, with portions shown in phantom, of the woofer housing of the orthogonal open back speaker system of the present invention.
Figure 11:
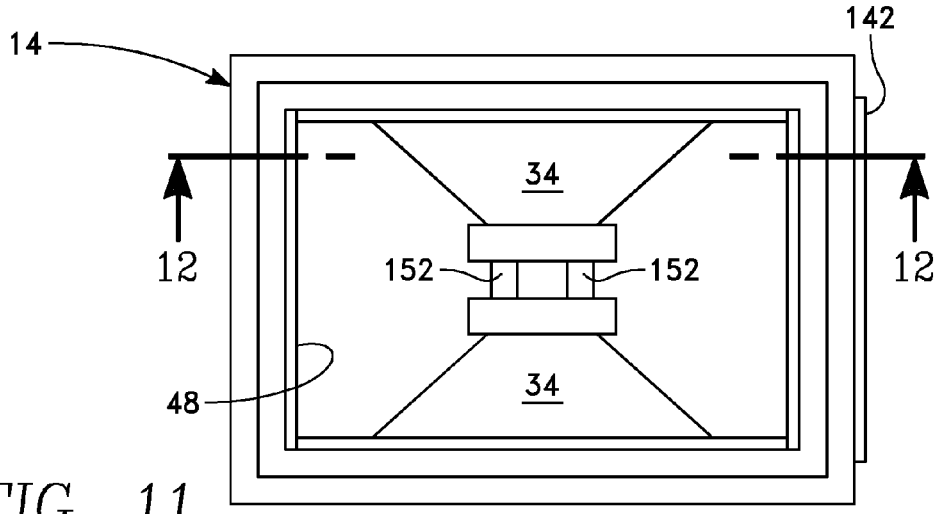
FIG. 11 is a top plan view of the woofer housing of FIG. 10.

In FIG. 10 a plate amplifier 142 is shown mounted in a rear panel 146 of the woofer housing 14 for use in driving the pair of woofers 34. As is best shown in FIG. 11, the pair of woofers 34 are oriented back-to-back and are structurally connected to one another utilizing a pair of wooden wedge blocks 152 to internally react the electro-dynamic forces that are equal and opposite the forces applied to the moving element.

In a presently preferred embodiment the orthogonal open back speaker system utilizes an upper housing fabricated out of ½-inch tempered clear glass panels, 2 of the panels measuring 42 inches in height and 8¼ inches in width, and the second pair of panels measuring 42 inches in height and 14¼ inches in width. The narrower panels are used for the front and back panels of the upper housing.

The edges of the panels are polished and the panels are attached to one another using an adhesive/sealant product such as GE® brand Supreme Silicone glass sealant. A pair of apertures are provided in the front panel to receive the tweeter driver and the mid-woofer driver. The aperture for the tweeter driver is 4 inches in diameter and the center is located 13¼ inches from the top edge of the panel. The aperture for the mid-woofer driver is 5 and 27/32 inches in diameter and the center is located 6 and ⅝ inches below the center of the tweeter aperture. The center of both apertures lies on the centerline for the glass panel.

The distance along the upper housing from each driver to the open end is sufficient to prevent early cancellation by the out of phase back wave, thus obtaining sufficient bass response for each driver. See Olson, "Music, Physics and Engineering," 2nd edition, p 338, Figure 9.14b, et seq. In some cases the duct formed by the upper housing may be so long that it would include a resonance in the upper end of the frequency band of the driver. The resonance frequency can be multiplied by adding one or more ports in the manner of holes in a flute.

The port aperture in the rear upper housing panel measures 2¾ inches in diameter and the center is located 14½ inches above the bottom edge of the rear panel. The center of the port aperture is located on the centerline of the rear glass panel.

The woofer housing is fabricated out of ¾-inch Medium Density Fiberboard, with the front and rear panels measuring 12¼ inches in width and 14¼ inches in height. The width of each lateral panel is 17 inches. Each of the woofer openings in the lateral panels measure 8 inches by 8 inches. The woofer duct opening measures 7⅜-inches by 14¼-inches. The collar attached to the woofer housing at the woofer duct opening is constructed using 4 pieces of ⅛-inch by 1½-inch Masonite that is attached to the woofer housing using glue and wood screws. Stringers measuring ⅝-inch by ⅝-inch of Medium Density Fiberboard are attached to and extend along the inside surfaces of the joints between the top panel and the top edges of the lateral panels to provide additional strength to support the weight of the upper housing. The opening in the rear panel of the woofer housing to receive the plate amplifier measures 6 inches by 10 inches.

Certain of the previous measurements have been adopted based upon the dimensions of particular drivers and woofer size. This invention is not to be viewed as so limited, and it is considered to be within the knowledge of one of ordinary skill in this art to adapt the teachings of the present invention to accommodate different drivers and tweeters than those disclosed hereinafter.

A presently preferred tweeter driver is tweeter Model SB26STAC-0000-4 manufactured by SB Acoustics of Brookfield, Wis. (www.sbacoustics.com). After removal of the non-reflective rear chamber a ¾-inch 90° plastic elbow duct is attached to the center-rear of the tweeter using an adhesive. The tweeter is mounted in the upper aperture in the front panel of the upper housing utilizing a circular piece of 5-inch diameter felt having a 2¼-inch central opening to receive the tweeter. The tweeter driver is mounted in a manner such that the attached 90° elbow directs the back output of the tweeter driver towards the open top of the upper housing.

A preferred mid-woofer is a Peerless Model 830883 having a Nomex® fiber cone, manufactured by Peerless Fabrikkerne, Ltd., of Mumbai, India, and offered through Madisound Speaker Components of Middleton, Wis. (www.madisound-speakerstore.com). A 4⅞-inch in diameter disk of ¾-inch Medium Density Fiberboard is attached to the rear surface of the mid-woofer magnetic housing. A 16-gauge steel plate having a 2 7/16-inch radius and an arc of 190° is attached to the bottom of the mid-woofer. The mid-woofer is mounted in the lower aperture in the front panel using a ½-inch spacer on the front side of the panel, with the orientation of the mid-woofer such that the metal baffle is located below the mid-woofer to reflect the back output of the speaker up toward the open top of the upper housing.

A preferred woofer is Model 12PF-8, a 12-inch GRS paper cone woofer, available at www.parts-express.com. The pair of woofers are mounted back to back as described above, and structurally connected using, for example, wooden wedge blocks with an adhesive. A suitable plate amplifier is Bash 300S Digital Subwoofer Plate Amplifier, available at www.parts-express.com.

Orientation of the orthogonal open back speaker system has the two woofers placed facing out from each side, and the front-to-back dimension of the speaker system is preferably sufficient to permit use of large-diameter woofers, which produce bass more efficiently. The vertical dimension of the speaker system is preferably as large as is practical to provide a greater acoustic path link from the back side of the woofers to their front side, as well as providing a sufficient height above the floor such that when a person is seated the tweeter lies slightly above ear level.

This optimized height is generally considered to be approximately 41 inches above the floor. A presently preferred height for the loudspeaker box is 56 inches as is discussed above. However, a range of between 45 and 60 inches is considered commercially acceptable, and the scope of the present inventive loudspeaker box design should not be viewed as being limited to a certain height or range of heights.

The pair of 12-inch diameter woofers, vented to opposing sides of the woofer housing, are provided speaker openings of 64 square inches. Such speaker openings are preferably at least one-half the area of the woofer piston, with the typical 12-inch woofer having a piston area of approximately 75 square inches. The open top and height of the speaker system, 56 inches as discussed above, create a sufficiently long acoustic path between the front and back of the woofer cone to prevent excessive cancellation of the two sound waves (which are of opposite phase). The configuration of the present invention produces powerful bass notes down to the mid-thirties ("hertz" or "cycles per second").

The woofers are separately powered by a "plate" or sub-woofer amplifier that is capable of providing power levels of 70 watts or more. Many examples of such amplifiers are shown and available at the website: www.parts-express.com, and the present invention is not limited to a specific model or manufacturer.

The port aperture formed in the back panel produces a null in the longitudinal cavity resonance at its location, which in turn results in the lowest frequency acoustic resonance (organ pipe) to be well above the woofer cut-off frequency of approximately 110 Hz, thereby avoiding that source of retained energy. In a presently preferred embodiment the total area of the port opening is approximately 5% (five percent) of the loudspeaker box horizontal cross-sectional area. This aperture area/cross-sectional area relationship is well-known in the art of musical instrument design and represents the required proportion of acoustic power removal per acoustic cycle to prevent resonance build-up. That is, an acoustic resonance will increase in amplitude approximately 5 percent per cycle. Optimization may be of slight benefit.

The mid-woofer driver is positioned approximately 20 inches from the top of the loudspeaker box. This distance is sufficient to provide an adequate acoustic pathway, along with the metal baffle inside the upper housing, for desired bass extension. The mid-woofer driver is utilized to provide the mid-bass section that extends over the range of 110-2500 Hz. The metal baffle attached to the underside of the mid-woofer driver is oriented to direct the sound energy in an upwardly manner and towards the open top of the upper housing. Such sound direction, for both the tweeter driver and for the mid-woofer driver, assists in reducing cavity resonance within the speaker system enclosure The general configuration of the orthogonal open back speaker system permits the minimization of residual energy, as with all open-back loudspeakers, but with the capability of fully extended low frequency output. The speaker damping is only limited by the inherent electro-mechanical damping, which is very high compared with box speaker damping. Thus transient response is far superior to ordinary box speakers. Electrostatic and other planar speakers have transient problems due to late arrival of sound from parts of the plane further away, with the sound arriving late and out of phase.

The general configuration contemplated by the present invention can virtually eliminate undesirable room resonance response and reflections off the walls and ceiling. The driver back wave is opposite phase with the front wave directed toward the listener. The back wave is directed toward the ceiling, and spreads out over the ceiling and down the walls and across the floor. When the front wave expands toward the ceiling, walls, and floor it meets the opposite phase back wave, and is cancelled—thus eliminating excitation of room resonances and reflections. An enormous improvement/advantage. By not driving room resonances, it is not necessary to set the speakers out away from the walls. Speakers may thus be placed near the wall, providing excellent bass output.

My invention has been disclosed in terms of a preferred embodiment thereof, which provides an orthogonal open back speaker system that is of great novelty and utility. Various changes, modifications, and alterations in the teachings of the present invention may be contemplated by those skilled in the art without departing from the intended spirit and scope thereof. It is intended that the present invention encompass such changes and modifications.

What is claimed is:

1. An orthogonal open back speaker system comprising:

a duct housing defining an interior acoustic space, said duct housing having a top end and a bottom end, wherein said duct housing is closed at said bottom end and open at said top end;

a pair of drivers are provided, each of said pair of drivers separately mounted in said duct housing, wherein the back side of each of said pair of drivers is in acoustic communication with said interior acoustic space of said duct housing, and wherein one of said pair of drivers is a mid-woofer driver;

a pair of acoustic diverters are provided, each of said pair of acoustic diverters attached to a separate one of said pair of drivers and positioned relative to the back side thereof in a manner directing acoustic energy of the back side toward said open top end of said duct housing, wherein one of said pair of acoustic diverters is a metal baffle, and wherein said metal baffle is attached to a bottom surface of said mid-woofer driver; and a rigid disk attached to an end of said mid-woofer driver, and wherein said metal baffle extends from a position adjacent to said duct housing to an attachment location on said rigid disk.

2. The orthogonal open back speaker system of claim 1, wherein one of said pair of drivers is a tweeter driver.

3. The orthogonal open back speaker system of claim 2, wherein one of said pair of acoustic diverters is an elbow duct, and wherein said elbow duct is attached to a rear surface of said tweeter driver.

4. An orthogonal open back speaker system comprising:

a duct housing defining an interior acoustic space, said duct housing having a top end and a bottom end, wherein said duct housing is closed at said bottom end and open at said top end, and wherein said duct housing comprises an upper housing and a woofer housing, said upper housing received by and resting upon said woofer housing, and wherein said upper housing comprises an elongate linear enclosure defining an interior duct having first and second ends, and said woofer housing comprises an enclosure having four lateral panels and a top and bottom panel, with a woofer duct opening formed in said top panel, and wherein, upon placement of said upper housing upon said top panel of said woofer housing, said interior duct formed within said upper housing acoustically extends into said woofer housing;

a driver mounted in said upper housing, wherein said back side of said driver is in acoustic communication with said interior acoustic space of said upper housing; and an acoustic diverter attached to said back side of said driver, said acoustic diverter positioned relative to said back side of said driver in a manner directing acoustic energy of said back side toward said open top end of said upper housing.

5. The orthogonal open back speaker system of claim 4, wherein a pair of said four lateral panels of said woofer housing each have a woofer opening formed therein, and further comprising a pair of woofers mounted within said woofer housing, each of said pair of woofers oriented to outwardly project acoustic energy through a separate woofer opening.

6. The orthogonal open back speaker system of claim 5, wherein said pair of woofers are oriented back-to-back, and further comprising a pair of wooden wedge blocks, each attached to and extending between opposing rear surfaces of said pair of woofers.

7. The orthogonal open back speaker system of claim 6, wherein a port aperture is formed in said upper housing at a vertical location therein, said port aperture providing a null in the longitudinal cavity resonance at said vertical location.

8. The orthogonal open back speaker system of claim 7, wherein said port is formed in said upper housing and wherein a pair of drivers are separately mounted in said upper housing.

9. A speaker system comprising:

first and second drivers having respective front and rear surfaces for radiating acoustic energy;

a duct housing defining an elongate linear enclosure having top and bottom ends, wherein said top end is open and said bottom end is closed, said duct housing having a front panel, the front panel having a pair of apertures therethrough for receiving said first and second drivers, respectively, wherein said closed bottom end of said duct housing is configured as a woofer housing;

a pair of woofers attached to one-another in a back-to-back manner, wherein said pair of woofers are mounted within said woofer housing; and a first and second diverter, each attached to said rear surface of a respective one of said first and second drivers, with said first and second drivers and attached first and second diverters oriented to divert acoustic energy radiated by said rear surface in a direction toward the open top end of said duct housing.

10. The speaker system of claim 9, wherein a pair of woofer openings are formed in said woofer housing at locations corresponding to a front surface of each of said pair of woofers, and wherein a port aperture is formed in said duct housing at a vertical location therein, said port aperture providing a null in the longitudinal cavity resonance at said vertical location.

* * * * *